US008711046B2

(12) United States Patent
Copeland et al.

(10) Patent No.: US 8,711,046 B2
(45) Date of Patent: Apr. 29, 2014

(54) WIDE BANDWIDTH HYBRID ANTENNA FOR COMBINATION EAS AND RFID LABEL OR TAG

(75) Inventors: Richard L. Copeland, Lake Worth, FL (US); Edward Day, Pembroke Pines, FL (US)

(73) Assignee: Tyco Fire & Security Services GmbH, Neuhausen am Rheinfall (CH)

( * ) Notice: Subject to any disclaimer, the term of this patent is extended or adjusted under 35 U.S.C. 154(b) by 281 days.

(21) Appl. No.: 13/171,822

(22) Filed: Jun. 29, 2011

(65) Prior Publication Data

US 2012/0001814 A1 Jan. 5, 2012

Related U.S. Application Data

(60) Provisional application No. 61/398,816, filed on Jul. 1, 2010.

(51) Int. Cl.
*H01Q 21/00* (2006.01)

(52) U.S. Cl.
USPC ..... 343/726; 343/741; 343/793; 340/572.7

(58) Field of Classification Search
USPC ..... 343/725, 726, 727, 728, 793, 795, 741; 340/572.7
See application file for complete search history.

(56) References Cited

U.S. PATENT DOCUMENTS

| | | | | |
|---|---|---|---|---|
| 7,605,761 | B2 * | 10/2009 | Yanagisawa et al. | 343/700 MS |
| 2007/0200705 | A1 * | 8/2007 | Yamagajo et al. | 340/572.7 |
| 2008/0068177 | A1 * | 3/2008 | Copeland | 340/572.7 |
| 2008/0088460 | A1 | 4/2008 | Copeland | |
| 2008/0143620 | A1 * | 6/2008 | Khatri | 343/726 |
| 2008/0266191 | A1 * | 10/2008 | Hilgers | 343/726 |

FOREIGN PATENT DOCUMENTS

| | | | |
|---|---|---|---|
| EP | 1826711 | A1 | 8/2007 |
| WO | 03/044892 | A1 | 5/2003 |
| WO | 2007/054900 | A2 | 5/2007 |

OTHER PUBLICATIONS

International Search Report and Written Opinion dated Oct. 19, 2011 for International Application Serial No. PCT/US2011/001162, International Filing Date: Jun. 29, 2011, consisting of 13 pages.

* cited by examiner

*Primary Examiner* — Dieu H Duong
(74) *Attorney, Agent, or Firm* — Alan M. Weisberg; Christopher & Weisberg, P.A.

(57) ABSTRACT

A radio frequency identification (RFID) antenna exhibiting a multiple resonance is disclosed. In one exemplary embodiment, a dipole antenna and a loop antenna are disposed upon a substrate and have dimensions and orientation to exhibit the multiple resonance. The dipole antenna may exhibit a first dipole section having a first length and second dipole section having a second length. The loop antenna may be disposed in a region of the dipole antenna. The ratio of the perimeter of the loop antenna to the sum of the lengths of the dipole sections may be selected to exhibit the multiple resonance.

13 Claims, 7 Drawing Sheets

WIDE BANDWIDTH HYBRID ANTENNA FOR COMBINATION EAS AND RFID LABEL OR TAG

CROSS-REFERENCE TO RELATED APPLICATION

This application is related to and claims priority to U.S. Provisional Application Ser. No. 61/398,816, filed Jul. 1, 2010, entitled WIDE-BANDWIDTH ANTENNA FOR A COMBINATION EAS AND RFID LABEL OR TAG, the entirety of which is incorporated herein by reference.

STATEMENT REGARDING FEDERALLY SPONSORED RESEARCH OR DEVELOPMENT n/a

FIELD OF THE INVENTION

The present invention relates generally to wide band antennas and more specifically to a method and system for a wide band Radio Frequency Identification (RFID) antenna.

BACKGROUND OF THE INVENTION

Electronic article surveillance (EAS) systems are generally known in the art for the prevention or deterrence of unauthorized removal of articles from a controlled area. In a typical EAS system, EAS markers (tags or labels) are designed to interact with an electromagnetic field located at the exits of the controlled area, such as a retail store. These EAS markers are attached to the articles to be protected. If an EAS tag is brought into the electromagnetic field or "interrogation zone," the presence of the tag is detected and appropriate action is taken, such as generating an alarm. For authorized removal of the article, the EAS tag can be deactivated, removed or passed around the electromagnetic field to prevent detection by the EAS system.

Radio-frequency identification (RFID) systems are also generally known in the art and may be used for a number of applications, such as managing inventory, electronic access control, security systems, and automatic identification of cars on toll roads. An RFID system typically includes an RFID reader and an RFID device. The RFID reader transmits a radio-frequency carrier signal to the RFID device. The RFID device responds to the carrier signal with a data signal encoded with information stored by the RFID device.

The market need for combining EAS and RFID functions in the retail environment is rapidly emerging. Many retail stores that now have EAS for shoplifting protection rely on bar code information for inventory control. RFID offers faster and more detailed inventory control over the bar code. Retail stores already pay a considerable amount for hard tags that are re-useable. Adding RFID technology to EAS hard tags could easily pay for the added cost due to improved productivity in inventory control as well as loss prevention.

Dual technology tags that operate as an EAS tag and an RFID tag are described in U.S. Patent Application Publication No. 2008-0068177, which is incorporated herein by reference in its entirety. This Publication discloses the use of a single resonance RFID antenna that is tuned to a desired operating frequency by adjusting a length of the RFID antenna. Due to the narrow band response of this antenna, it is necessary to tune the antenna to a specific frequency depending on the telecommunications regulations of the country or region in which the tag is deployed. For example, the European Telecommunications Standards Institute (ETSI) and the US Federal Communications Commission (FCC) each specify different frequency ranges for EAS/RFID systems. A tag design tuned to a single RFID resonance frequency cannot be used in both European and the U.S. markets. Producing multiple versions of the tags which are tuned for use in multiple markets adds to production costs.

Therefore, what is needed is an RFID antenna that provides a wide enough bandwidth to allow use in multiple frequency regions.

SUMMARY OF THE INVENTION

The present invention advantageously provides a method and system for a wide band antenna. The present invention more particularly provides a method and system for a Radio Frequency Identification (RFID) wide band antenna that can be used in security tags in multiple regions, i.e., using different operating frequencies. According to one aspect, an RFID antenna has a dipole antenna including a first dipole section having a first length and a second dipole section having a second length, each of the first and second dipole sections disposed in opposite directions. In a region of the dipole antenna, there is disposed a loop having a perimeter, the loop being electrically coupled to the first dipole section and electrically coupled to the second dipole section. The lengths of the first and second dipole sections and the perimeter of the loop are selected to achieve a dual resonance in a predetermined frequency band.

According to another aspect, the invention provides a combination Electronic Article Surveillance (EAS)/RFID security tag. The tag includes an EAS component, a dipole antenna and a magnetic loop. The dipole loop has a first section having a first length, and a second section having a second length. The loop antenna has a perimeter and is positioned between the first section and the second section. The dimensions of the dipole antenna and the loop antenna are selected to exhibit a dual resonance in a frequency band.

According to yet another aspect, the invention provides a method of providing an RFID antenna. The method includes choosing dimensions and orientation of a dipole antenna and a loop antenna to exhibit a dual resonance in a selected frequency band. The method further includes disposing on a substrate a conductor patterned to exhibit a dipole antenna and a loop antenna of the chosen dimensions and orientation.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
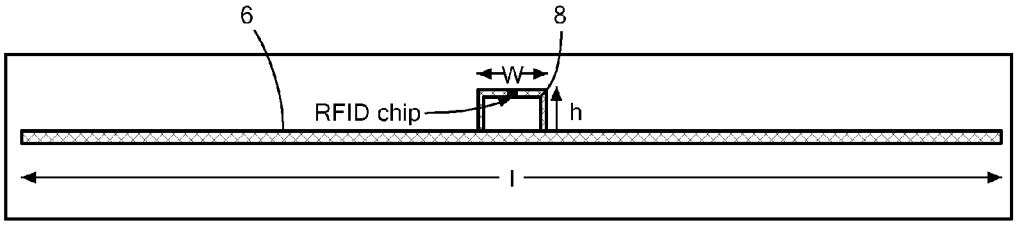
FIG. 1 is a diagram of a first exemplary hybrid antenna constructed in accordance with the principles of the present invention.

Before describing in detail exemplary embodiments that are in accordance with the present invention, it is noted that the embodiments reside primarily in combinations of apparatus components and processing steps related to implementing a multiple resonance antenna that provides wide band performance. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

A radio frequency identification (RFID) antenna exhibiting a multiple resonance to provide a wide band response is disclosed. In one exemplary embodiment, a dipole antenna and a loop antenna are disposed upon a substrate and have dimensions and orientation to exhibit the multiple resonance. Although an antenna is described herein that exhibits a dual resonance, this is but one example. Antennas with multiple resonances constructed in accordance with the principles of the invention described herein are encompassed by the appended claims. The dipole antenna may exhibit a first dipole section having a first length and second dipole section having a second length. The loop antenna may be disposed in a region of the dipole antenna. The ratio of the perimeter of the loop antenna to the sum of the lengths of the dipole sections may be selected to exhibit the multiple resonance. The loop perimeter refers to the mean length around the loop antenna. The total dipole length refers to the mean path length from the end of one dipole branch to the end of the other dipole branch.

Figure 2:
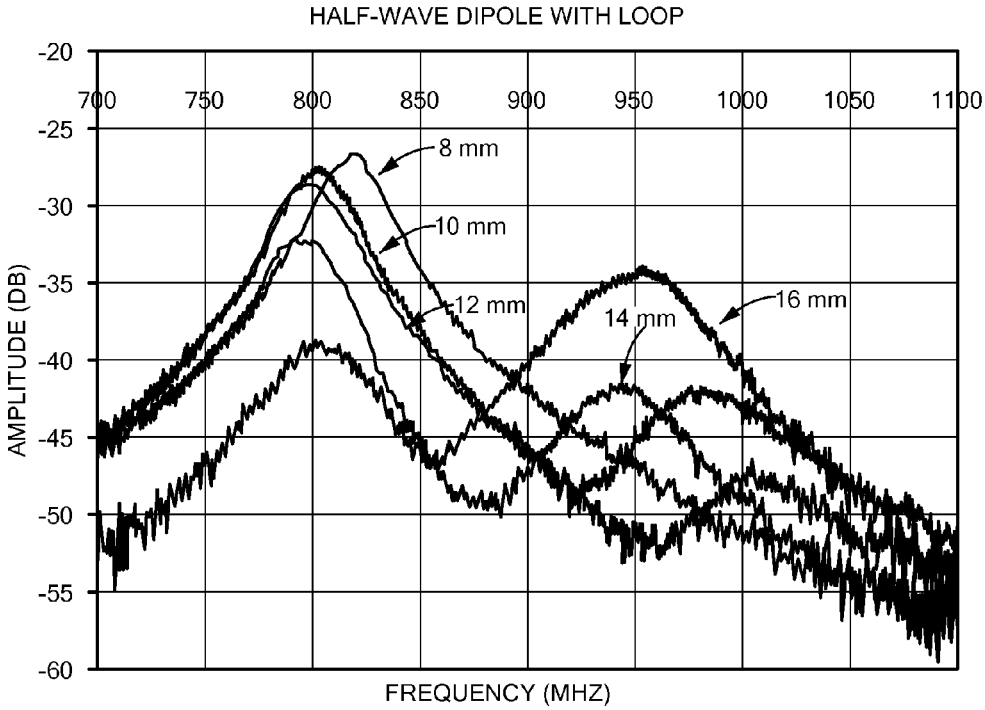
FIG. 2 is a graph of frequency responses of an antenna constructed according to principles of the present invention having different sizes of a rectangular loop antenna coupled to a half wave dipole.

Referring now to the drawing figures, in which like reference designators denote like elements, there is shown in FIG. 1 a diagram of a first exemplary embodiment of a simple half-wave dipole antenna 6 having a length "l" with a loop antenna 8 having a perimeter defined by (("w"+"h")*2) situated between the branches of the dipole antenna 6. An RFID chip may be situated at a point of the loop antenna 8 and conductively coupled to the loop antenna. FIG. 2 is a graph of frequency responses for different sizes of a rectangular loop antenna 8, situated between the simple half-wave dipole 6, for loop perimeters of 8, 10, 12, 14 and 16 millimeters (mm). As can be seen, as the perimeter size of the loop antenna increases, a second resonance becomes more pronounced and moves in a direction toward a first resonance which decreases slightly and moves to the left as the loop perimeter size increases. The existence of the dual resonances provides a broadband response for the RFID antenna so that a single antenna structure can be responsive at both the ETSI and FCC ranges specified for EAS/RFID systems. In particular when the ratio of the loop perimeter to dipole length is greater than a certain value, the antenna exhibits a multiple resonance. For example, for a ratio of about 0.35, when the loop perimeter is about 14 mm, the frequency spread between the resonances is about 160 Mega-Hertz (MHz). For a ratio of about 0.37, when the loop perimeter is about 16 mm, the frequency spread between the dual resonances is about 150 MHz.

Figure 3:
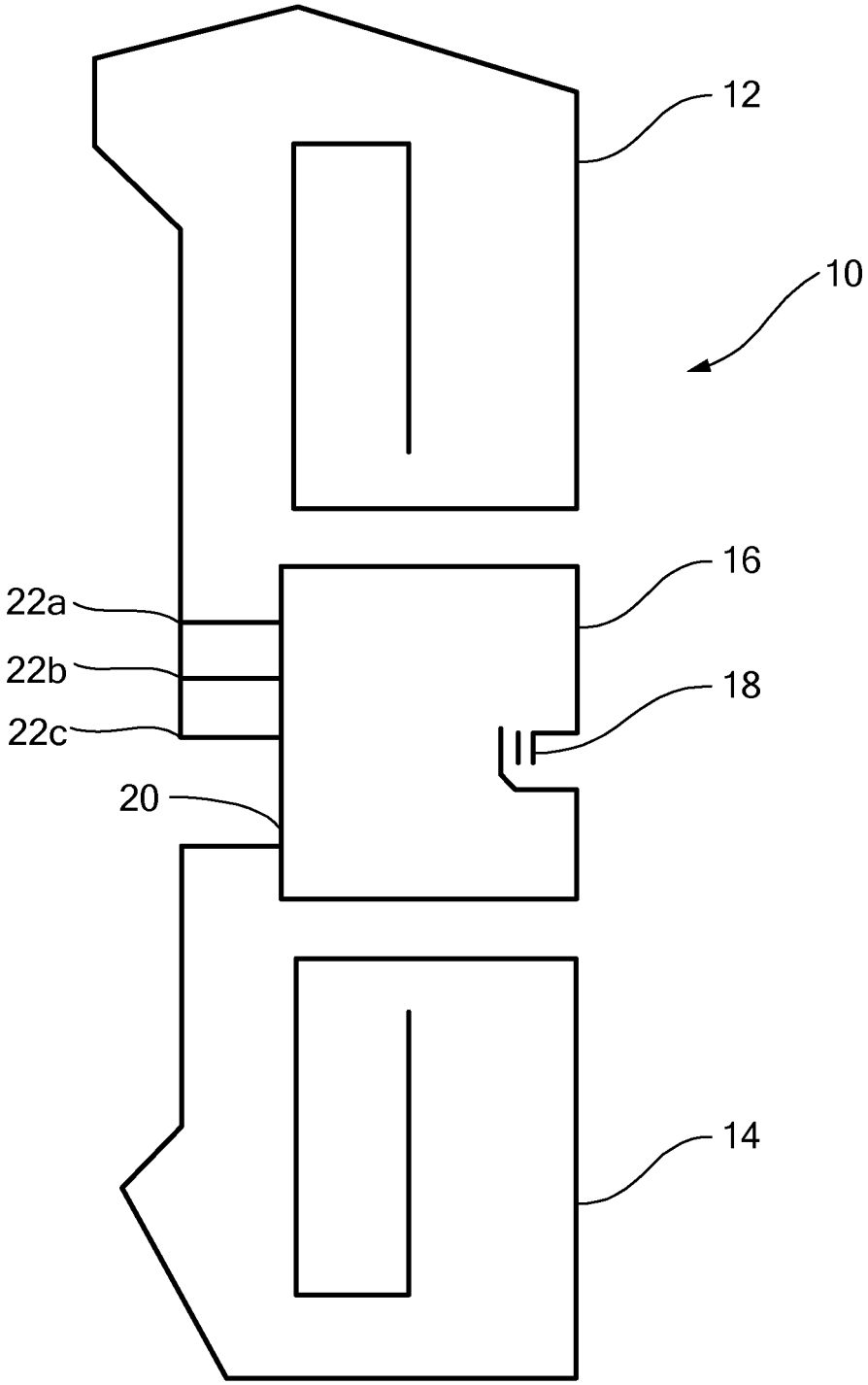
FIG. 3 is a diagram of a second exemplary hybrid antenna constructed in accordance with the principles of the present invention.

FIG. 3 is a second exemplary hybrid RFID antenna generally denoted as RFID antenna "10." The RFID antenna 10 includes a dipole antenna that includes a first dipole section 12 and a second dipole section 14. In one embodiment, the dipole sections 12 and 14 are spiral conductors that radiate a desirable far field pattern. The RFID antenna 10 includes a loop antenna 16 which radiates a desired near field. The loop antenna 16 is located at an approximate center region of the dipole antenna formed by dipole sections 12 and 14. Positioned at a terminal point of the loop antenna 16 is a RFID integrated circuit device 18 that receives a signal acquired by the RFID antenna 10, when the RFID IC device 18 operates in a receive mode, and that sends a signal via the RFID antenna 10, when the RFID IC device 18 operates in a transmit mode.

The lengths of the dipole sections 12 and 14 and the perimeter of the loop antenna 16 are chosen so that RFID antenna 10 exhibits a multiple resonance, resulting in a broad band frequency response. More particularly, the ratio of the perimeter of the loop antenna 16 to the sum of the lengths of dipoles sections 12 and 14 is chosen to achieve a desired multiple resonance frequency response. In one embodiment the ratio is chosen to be about 0.25. For example, in one embodiment the loop perimeter is chosen to be 14 millimeters (mm), and the lengths of the dipole sections are chosen to have a combined length of 58 mm. In another embodiment, the loop perimeter is about 40.6 mm and the overall dipole length is about 171 mm. In some embodiments, the multiple resonance behavior results in a broadband response in the frequency range of 860 Megahertz (MHz) to 960 MHz.

As shown in FIG. 3, the second dipole section 14 is conductively coupled to the loop antenna 16 at single coupling location 20, whereas the first dipole section 12 is conductively coupled to the loop antenna 16 at multiple coupling locations via feed tabs 22*a*, 22*b*, and 22*c*, (referred to collectively herein as "feed tabs 22"). Conductively coupling a dipole section to the loop antenna at multiple places has a broadening effect upon a resonance of the frequency response of the RFID antenna 10 arising from the different path lengths afforded by the multiple feed tabs 22. The configuration and number of coupling locations also effectively controls the separation of the low and high resonances of the dual resonance antenna. In some embodiments, the second dipole section 14 may also be coupled to the loop antenna 16 at multiple places. The configuration and number of the feed tabs 22 can be selected to provide a desired broadband multiple resonance frequency response.

The antenna 10 of FIG. 3 has a loop current and a dipole current that may be 90 degrees out of phase. This phase relationship results in three distinct modes. A first mode occurs when the dipole current is at a maximum and the loop current is at a minimum. A second mode occurs when the dipole current and the loop current are about the same. A third mode occurs when the dipole current is at a minimum and the loop current is at a maximum. The first two modes contribute to the far field pattern of the antenna, whereas the third mode does not radiate. The first mode produces a higher resonance frequency while the second mode produces a lower resonance frequency. When the loop size is very small compared to the dipole length, both the high and low resonance frequencies merge into a single resonance. Thus, the separation between the high and low resonance frequencies can be adjusted by adjusting the length of the loop size. For example, a suitable ratio of the loop perimeter to total dipole length may be in the range of 0.22 to 0.35 to achieve a dual resonance between 860 to 960 MHz.

Figure 4:
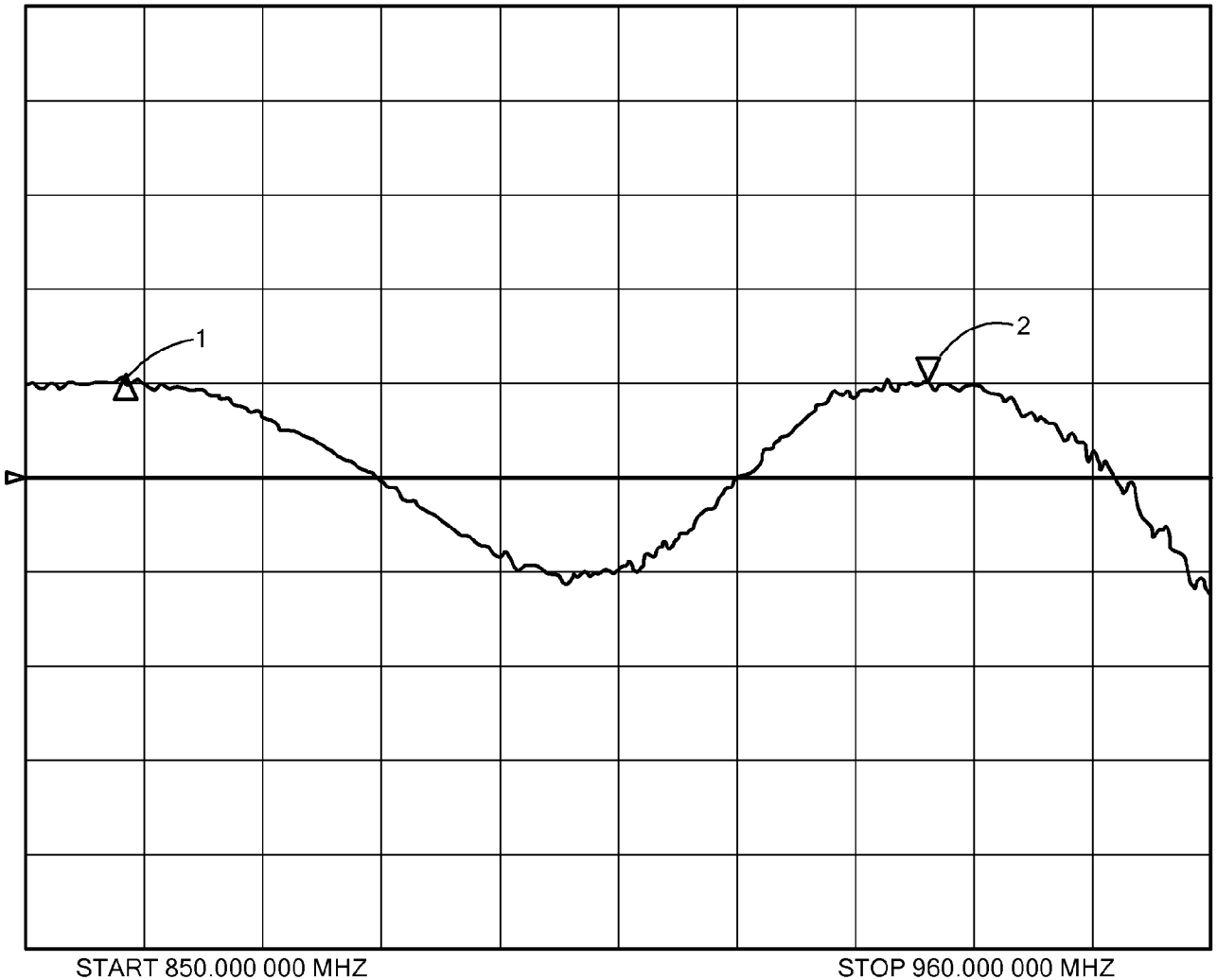
FIG. 4 is a graph of a measured frequency response of the antenna of FIG. 3 showing a dual resonance.

FIG. 4 is a graph of a measured frequency response of the antenna 10 of FIG. 3, in the case where the RFID inlay, i.e., RFID antenna and chip, is placed inside of a combination EAS and RFID security tag. Note that two resonances occur between 850 and 960 MHz. In particular, FIG. 4 shows one resonance at about 859 MHz, (marker #1) and another resonance at about 924 MHz (marker #2). The dual resonance is achieved by varying the size of the loop antenna relative to the length of the dipole antenna, within a preferred range. The depth of the valley between the resonances decreases as the resonant frequencies are moved closer together. For the graph of FIG. 4, the ratio of the loop perimeter to total dipole length is about 0.25.

Figure 5:
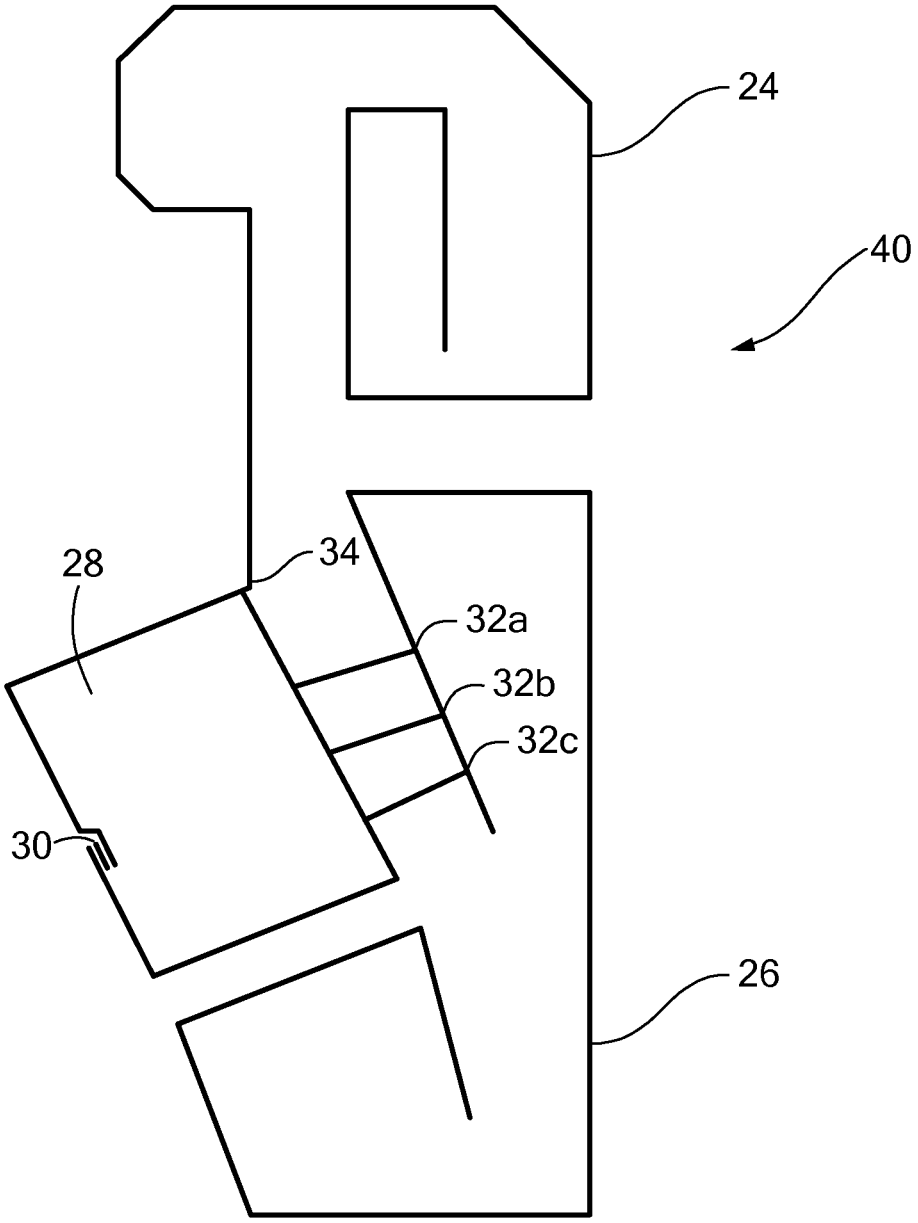
FIG. 5 is a diagram of a third exemplary hybrid antenna constructed in accordance with the principles of the present invention.
Figure 6:
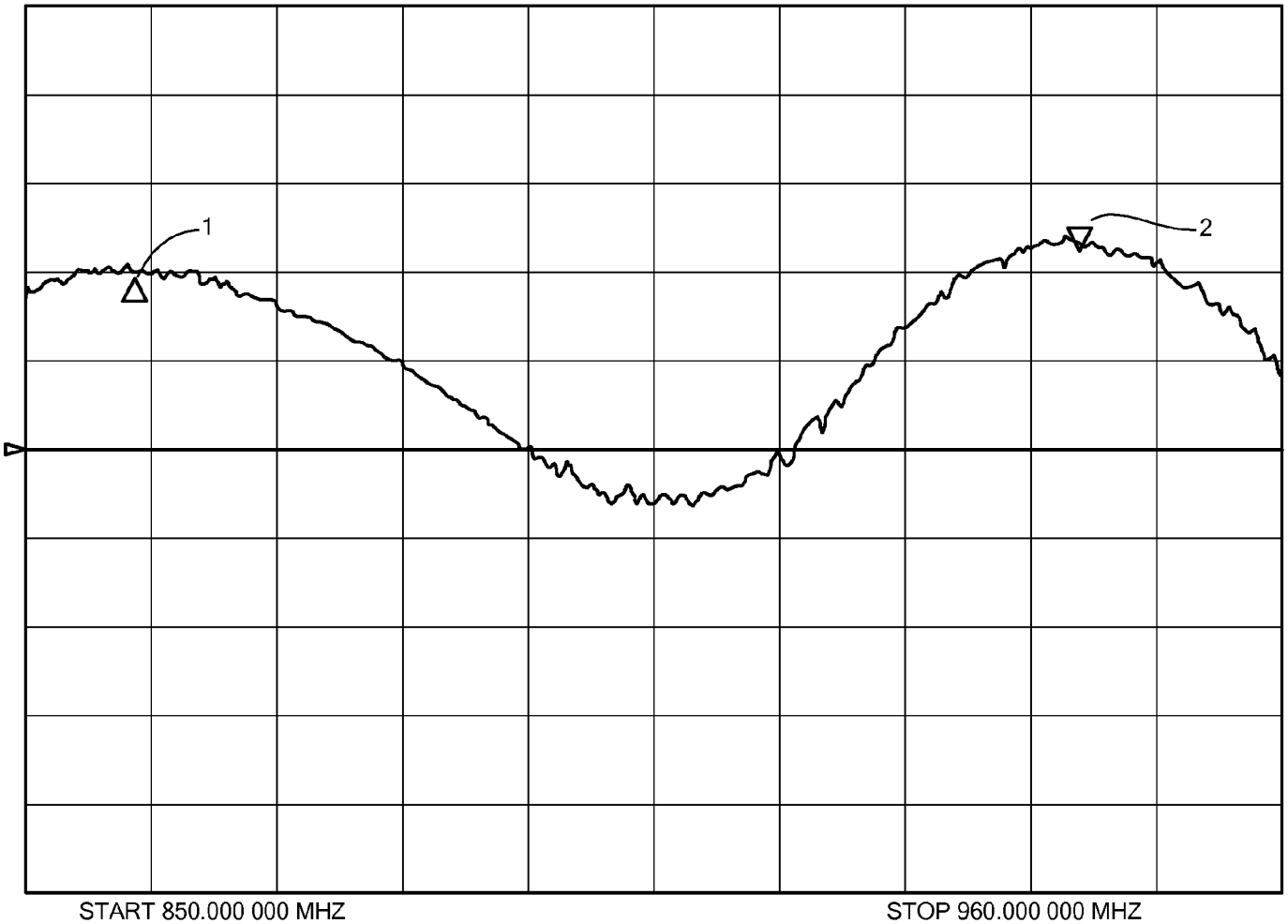
FIG. 6 is a graph of a measured frequency response of the antenna of FIG. 5 showing a dual resonance.

FIG. 5 shows a third exemplary embodiment of a hybrid RFID antenna 40 having a broadband multiple resonance frequency response. As discussed below, the third embodiment may be used in a combination EAS/RFID tag. Of note, although the third embodiment is discussed herein and with respect to FIGS. 6 and 7 in a combination EAS/.RFID tag, it is contemplated that other embodiments, such as those described herein with reference to FIGS. 1-3 are likewise suitable for use in a combination EAS/RFID tag. The geometry of this embodiment is adapted for use in a Visible Source Tag (VST). In this embodiment, a far field antenna is a dipole antenna which includes first and second spiral antennas 24 and 26. In this embodiment, the first and second spiral antennas 24 and 26 forming the dipole are asymmetrically configured. A near field antenna, the loop antenna 28, is electrically connected to spiral antennas 24 and 26. The loop antenna 28 is electrically connected to the first spiral antenna 24 at a single point of connection 34. The loop antenna 28 is connected to the second spiral antenna 26 at a plurality of coupling locations via feed tabs 32*a*, 32*b*, and 32*c* (referred to collectively as "feed tabs 32".) The number and positioning of the multiple feed tabs 32 are selected to advantageously affect the peaks of the resonance response. The positioning of the feed tabs 32 on one side of the loop, i.e. joining the tabs only with the second spiral antenna 26, serves to broaden the low frequency resonance. Note that the central loop is positioned at an acute angle with respect to one of the dipole sections. The asymmetrical configuration of the central loop antenna 28 advantageously positions the loop antenna at a greater distance from an EAS component, resulting in better performance. In some embodiments, the acute angle is substantially between 45 and 60 degrees. In one embodiment, a spacer such as a low loss dielectric material or air is used to separate the EAS and RFID elements FIG. 6 is a measured frequency response of the antenna 40 of FIG. 5, showing two resonances in the frequency band between 860 and 960 MHz. In particular, one resonance occurs at about 859 MHz (marker #1) and another resonance occurs at about 942 MHz (marker #2). The dual resonance is achieved by selecting the dipole length and loop perimeter to be in a prescribed ratio falling within a preferred range. For the antenna of FIG. 6, the loop perimeter is about 40.6 mm, and the overall dipole length is about 170.59 mm, having a ratio of about 0.238. In some embodiments, the ratio is in the range of 0.22 to 0.35. In some embodiments, the overall dipole length is substantially between 40 mm and 230 mm and the loop perimeter is substantially between 14 mm and 50 mm.

Figure 7:
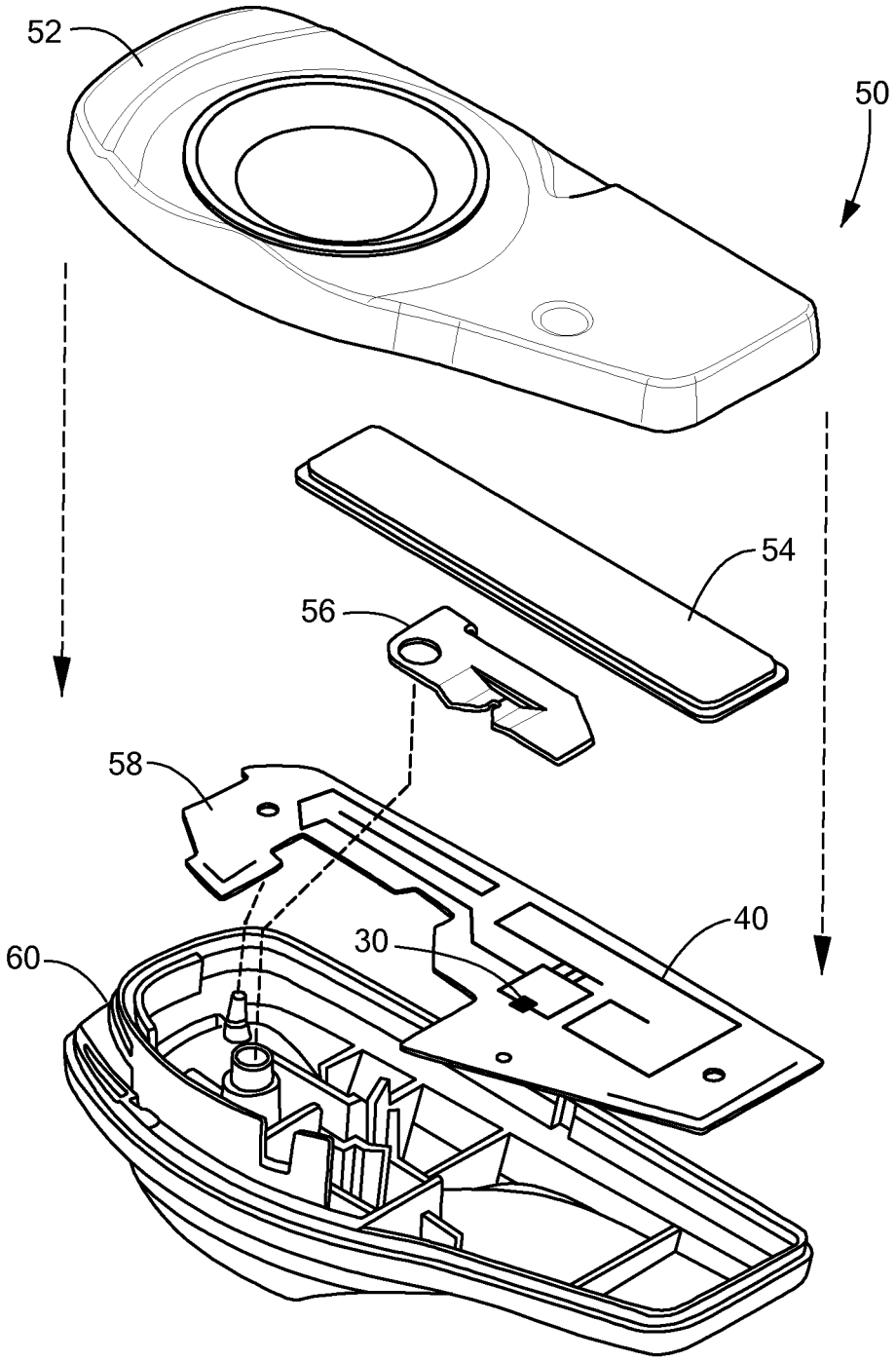
FIG. 7 is an exploded view of a combination EAS and RFID security tag constructed in accordance with the principles of the present invention.

FIG. 7 is an exploded view of an exemplary visible source tag (VST) item level intelligence (ILI) combination EAS and RFID security tag 50. The security tag 50 has a top housing 52, an EAS element 54, a clamp 56, an RFID inlay 58, upon which is etched an RFID antenna element 40, and a bottom housing 60. There is an overlapping of the EAS and RFID elements and they are separated by a gap that is typically in the range of approximately 3 to 5 mm. The EAS 54 element may be an acousto-magnetic element as is known in the art. The RFID antenna element 40 is tuned, as described herein, to support a wide frequency band with multiple resonances when the RFID antenna element 40 is enclosed with the EAS element within the top housing 52 and the bottom housing 60. In other words, the tuning of the RFID antenna element 40 takes into consideration the effects of the EAS element 54. In one embodiment, the wide frequency band exhibited by the RFID antenna element 40 is in the range of 860-960 MHz.

Figure 8:
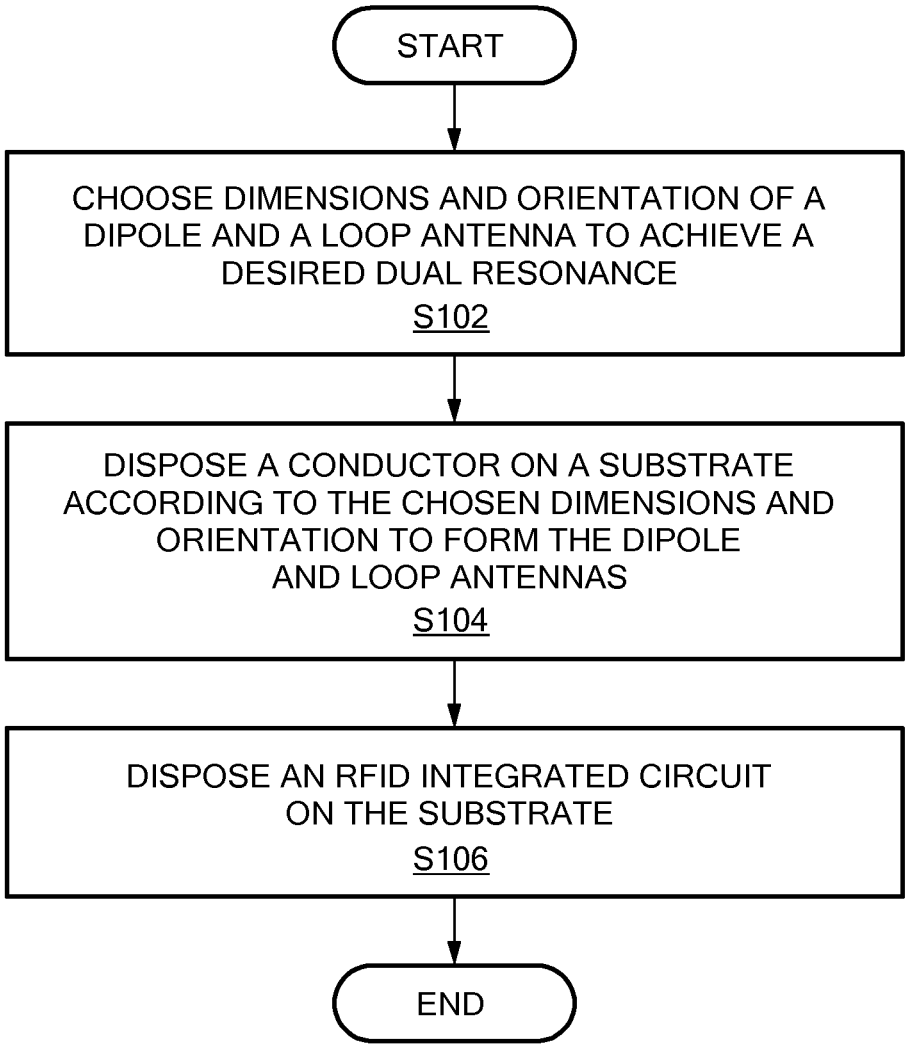
FIG. 8 is a flow chart of an exemplary process for designing an RFID antenna having a broadband frequency response.

FIG. 8 is a flow chart of an exemplary method for providing an RFID antenna having a broad band multiple resonance frequency response. An antenna design engineer may choose dimensions and orientation of a dipole antenna and a loop antenna to achieve a desired multiple resonance frequency response, (step S102). In particular, the ratio of the dipole length to the loop perimeter may be chosen so that the antenna exhibits a multiple resonance between 860 to 960 MHz. A conductor is disposed on a substrate, such as a dielectric substrate, according to the chosen dimensions and orientation specified for the dipole antenna and the loop antenna, (step S104). An RFID integrated circuit may also be disposed on the substrate and electrically coupled to the loop antenna, (step S106).

Unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A Radio Frequency Identification (RFID) antenna, comprising:

a dipole antenna including a first dipole section having a first length and a second dipole section having a second length;

a plurality of feed tabs; and a loop antenna having a perimeter, the loop antenna being electrically coupled to the first dipole section by at least one feed tab and electrically coupled to the second dipole section by a plurality of feed tabs, the length of the first and second dipole sections, the position of the loop antenna, and the number and positions of the plurality of feed tabs being selected to achieve a multiple resonance in a predetermined frequency band.

2. The RFID antenna of claim 1, wherein the electrical coupling is achieved by direct connection of conductors forming the dipole antenna and the loop antenna.

3. The RFID antenna of claim 1, wherein the loop antenna has a width and wherein the feed tab locations are no further than substantially a midpoint of the loop antenna width.

4. The RFID antenna of claim 1, wherein the loop antenna is substantially rectangular and is oriented at an acute angle with respect to the first dipole section of the dipole antenna.

5. The RFID antenna of claim 1, wherein the predetermined frequency band is from substantially 850 Megahertz (MHz) to substantially 960 MHz.

6. The RFID antenna of claim 1, wherein a ratio of the loop antenna perimeter to the sum of the lengths of the first and second dipole sections is between about 0.22 to about 0.35.

7. The RFID antenna of claim 1, wherein the loop antenna perimeter is substantially between 15 millimeters to 50 millimeters.

8. The RFID antenna of claim 7, wherein the sum of the lengths of the first and second dipole sections is substantially between 40 millimeters and 230 millimeters.

9. The RFID antenna of claim 1, further including a substrate, wherein the dipole antenna and the loop antenna are disposed upon the substrate.

10. The RFID antenna of claim 1, wherein the first dipole section is a clockwise spiral and the second dipole section is a counterclockwise spiral.

11. The RFID antenna of claim 1, wherein the loop antenna is interposed between the first and second dipole sections such that a distance between the first and second dipole sections is determined at least in part by a size of the loop antenna.

12. A combination Electronic Article Surveillance (EAS)/Radio Frequency Identification (RFID) security tag, comprising:

an EAS component;

an RFID component, comprising:

a dipole antenna having a first section having a first length and a second section having a second length;

a plurality of feed tabs; and a loop antenna in electrical communication with the dipole antenna by the plurality of feed tabs, the loop antenna having a perimeter, the first length and the second length of the dipole antenna, a position of the loop antenna and the numbers and positions of the plurality of feed tabs being selected to exhibit a multiple resonance in a predetermined frequency band.

13. The security tag of claim 12, further comprising an RFID integrated circuit coupled to the loop antenna.

* * * * *